US008794495B1

(12) United States Patent
Wathen

(10) Patent No.: US 8,794,495 B1
(45) Date of Patent: Aug. 5, 2014

(54) CARRIER FOR MOBILE PHONE

(76) Inventor: Lesley J. Wathen, Silver Spring, MD (US)

( * ) Notice: Subject to any disclaimer, the term of this patent is extended or adjusted under 35 U.S.C. 154(b) by 132 days.

(21) Appl. No.: 13/547,129

(22) Filed: Jul. 12, 2012

(51) Int. Cl.

| | |
|---|---|
| ***A45C 13/30*** | (2006.01) |
| ***A45F 5/00*** | (2006.01) |
| ***A45F 3/02*** | (2006.01) |
| *A45F 3/00* | (2006.01) |

(52) U.S. Cl.
CPC ..... *A45F 3/02* (2013.01); *A45F 2003/002* (2013.01)
USPC ..... 224/615; 224/600; 224/604

(58) Field of Classification Search
CPC ..... A45F 3/02; A45F 2005/006; A45F 2200/0508; A45F 2200/0516; A45F 2200/0525; A45F 2200/0533
USPC ..... 224/600, 602, 615, 677, 220, 254, 930, 224/604; 24/3.12, 457, 115 G
See application file for complete search history.

(56) References Cited

U.S. PATENT DOCUMENTS

| | | | | |
|---|---|---|---|---|
| 6,662,986 | B2 | 12/2003 | Lehtonen | |
| 7,174,196 | B2 | 2/2007 | Matsuda | |
| 7,416,099 | B2 | 8/2008 | deLéon et al. | |
| 2002/0043545 | A1 | 4/2002 | Tang | |
| 2004/0048639 | A1 | 3/2004 | Obolo | |
| 2005/0221762 | A1 * | 10/2005 | Greene | 455/66.1 |
| 2008/0041897 | A1 * | 2/2008 | Malhotra | 224/199 |
| 2009/0050658 | A1 * | 2/2009 | Boyd et al. | 224/245 |
| 2010/0162591 | A1 * | 7/2010 | Schmelzer et al. | 36/136 |

OTHER PUBLICATIONS

Universal Eeyore #01 Disney Cell Phone & iPod/MP3/Camera Sock Bacg carrying Case/Cover with Neck Strap. http://www.amazon.com/Universal-EEYORE-Disney-Camera-Carring/dp/B0030A25AK.

Miamica Deluxe Generation 2 Black Quilted Travel Cross Body Bag Neck ID Case PDA Cell Phone Blackberry iPhone Holder Wallet Purse. http://www.amazon.com/gp/product/B004871JC4/ref=pd_lpo_k2_dp_sr_3?pf_rd_p=486539851&pf_rd_s=lpo-top-stripe-1&pf_rd_t=201&pf_rd_i=B0030A25AK&pf_rd_m=ATVPDKIKX0DER&pf_rd_r=1Z1RM6J4BXBB2R84TZZ3.

* cited by examiner

*Primary Examiner* — Adam Waggenspack
(74) *Attorney, Agent, or Firm* — Robert C. Montgomery; Montgomery Patent & Design

(57) ABSTRACT

A carrier for mobile telephone provides a durable and flexible carrier element and an attachable decorative neck cord element. The position of the carrier upon the neck cord can be adjusted using an adjustable cord clasp. The front of the carrier can be adorned with various interchangeable ornamental adornments, such as jewelry, embroidered elements, and the like.

17 Claims, 12 Drawing Sheets

35

CARRIER FOR MOBILE PHONE

RELATED APPLICATIONS

Not Applicable.

FIELD OF THE INVENTION

The present invention relates generally to accessories for mobile electronic devices, and in particular, to a carrier for a mobile phone or other personal electronic device having interchangeable ornamental attachments.

BACKGROUND OF THE INVENTION

Wireless communication devices such as cellular phones, smart phones, and other portable electronic devices have seen a tremendous increase in usage in recent years. Almost all of these devices have cases with belt clips to allow the device to be worn about one's waist. While this method is certainly better than carrying the wireless device in a hand, pocket, or handbag, it does have some disadvantages. First, the device can be difficult to access quickly. This is especially true while sitting down in a motor vehicle. The physical gyrations necessary to remove a device from one's waist while in a moving car can cause the driver to lose control of the vehicle and cause an accident. Second, many users, particularly women who may be wearing dresses, do not have a suitable attachment point about the waist for the phone. Third, individuals such as joggers, bicycle riders, and the like may accidently lose the case and phone due to the strenuous movement during their exercise routine. Finally, many users are looking to make a fashion statement that does not include wearing a phone about the waist.

SUMMARY OF THE INVENTION

The inventor has recognized the aforementioned inherent problems and lack in the art and observed that there is a need for a device by which wireless communication devices or similar portable electronics can be more easily and safely accessed and carried in a fashionable manner. The principles of the present invention provide for a carrier for mobile telephones to address this identified need.

Accordingly, it is an object of the present embodiments of the invention to address this need by providing a device that is suitably constructed and configured for use with almost any style of cellular phone, smart phone, or portable electronic device.

It is another object of the present invention to provide a device that keeps the mobile telephone accessible without having to carry it in the hand, pocket, handbag, or belt.

It is another object of the present invention to provide a device that can be safely and comfortably worn around the user's neck.

It is another object of the present invention to provide a device that also provides a way for the user to accessorize a mobile phone holder with a variety of interchangeable ornamental jewelry or similar adornments in accordance with various levels of formality and dress.

The inventor has thus realized the advantages and benefits of providing a carrier for mobile telephones having various features for accomplishing at least one of the aforementioned objects.

A feature of the present invention is to provide a device that includes a carrier having an open interior configured to removably receive a mobile telephone. A decorative neck cord for extending around a neck of a user includes first and second ends that are removably attachable to the carrier. A cord clasp is removably attachable to the carrier for retaining the carrier to a selected location upon the neck cord. At least one ornamental adornment is removably attachable to the carrier to provide various decorative elements to the device.

Another feature of the present invention is that the carrier includes a front side for removable attachment of the ornamental adornment, a rear side directly connected to the front side by a bottom side for removable attachment of the neck cord and the cord clasp, a left side and a right side connected between opposing longitudinal edges of the front side and the back side, and an opening defined in a lower end of the left side and the right side being corners of the carrier. The front side and rear side are made of a durable and semi-rigid material. The left side and right side are made of a durable and semi-elastic material.

Another feature of the present invention is that the front side includes at least one adornment aperture for removable attachment of the ornamental adornments. The rear side includes two pairs of aligned cord apertures disposed in a middle portion to provide for threadable attachment of the neck cord and a slot disposed in a lower middle portion for removable attachment of the cord clasp.

Another feature of the present invention is that the cord clasp includes a clasp body having a first bore hole extending entirely through the clasp body for receiving the first end of the neck cord, a second bore hole extending entirely through the clasp body substantially parallel to the first bore hole for receiving the second end of the neck cord, and a third bore hole extending into the clasp body from a side substantially perpendicular to and at least partially intersecting the first and second bore holes. A shaft is disposed within the third bore hole for locking the first and second ends of the neck cord within the first and second bore holes when in an outwardly biased position. A first cut out and a second cut out are disposed in the shaft for alignment with the first and second bore holes when the shaft is in an inwardly biased position. A spring is provided for biasing the shaft in the outwardly biased position. A spring clip extends from an upper edge of a backside of the clasp body for insertable attachment within the slot.

Another feature of the present invention is that the ornamental adornments each include a decorative face and a pin extending perpendicularly outward from a back surface of the decorative face. The pin has a diameter approximately equivalent to an interior diameter of the adornment aperture. A flexible pin head is disposed on an end of the pin having a diameter greater than the interior diameter of the adornment aperture and is insertable therewithin.

Another feature of the present invention is to provide a method of carrying a mobile telephone around a neck of a user in a decorative manner including the steps of providing a carrier configured to receive a mobile phone having an open interior, at least one adornment aperture disposed in a front side, two aligned pairs of cord apertures disposed in a rear side, and a slot disposed in said rear side. Providing a neck cord having a first end and a second end. Providing a cord clasp attached to the slot having two bore holes for the passage of the first and second ends of the neck cord and a spring biased shaft for locking the first and second ends of the neck cord within the bore holes. Providing at least one ornamental adornment. Insertably attaching the ornamental adornment within the adornment aperture. Passing the first and second ends of the neck cord through the bore holes. Biasing the shaft to secure the first and second ends of the neck cord within the bore holes and suspending the carrier from the neck of the user.

Furthermore, the described features and advantages of the disclosure may be combined in various manners and embodiments as one skilled in the relevant art will recognize. The disclosure can be practiced without one or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

Figure 1:
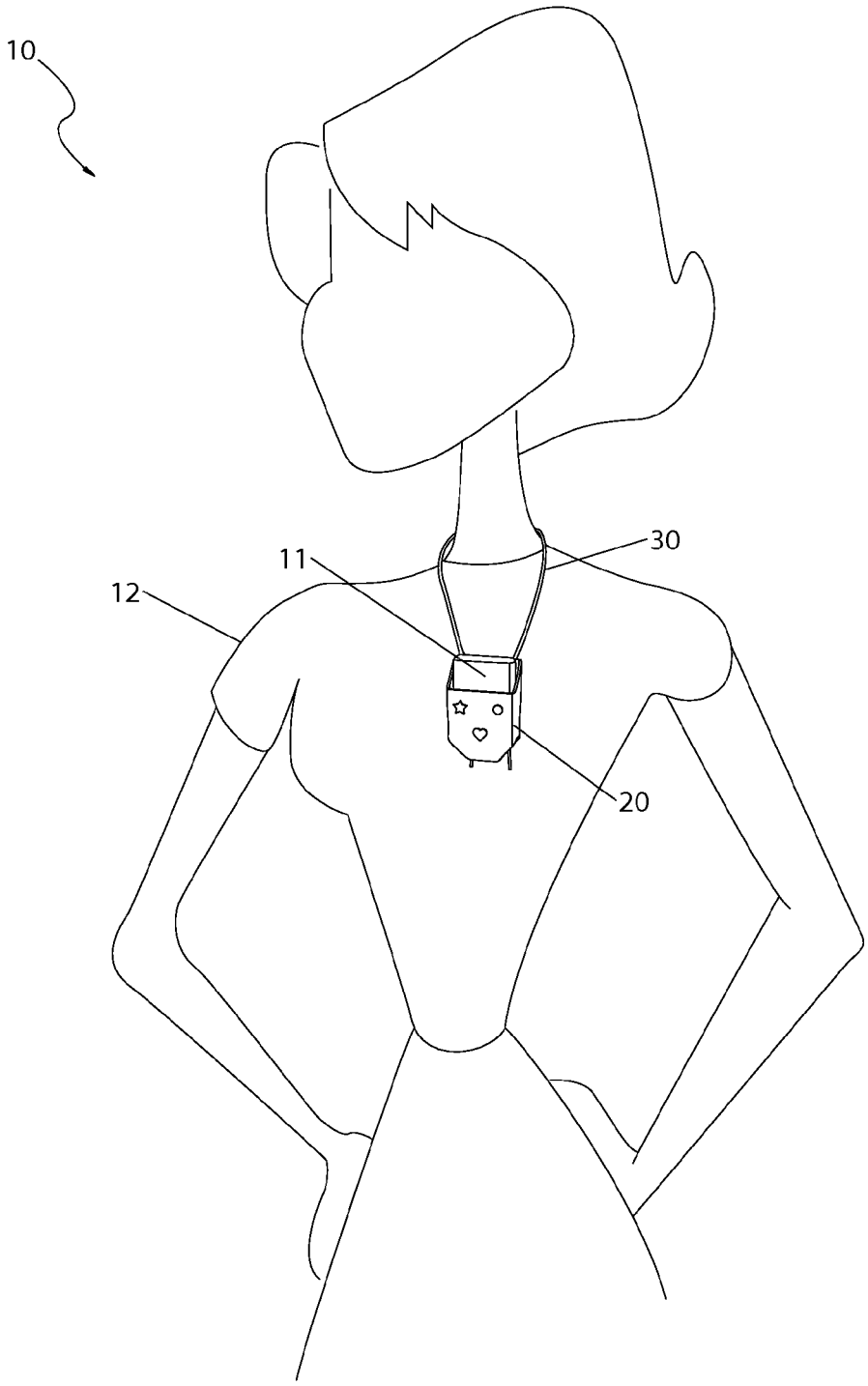
FIG. 1 is an environmental view of a carrier for mobile phone depicting a person wearing the carrier for mobile phone, in accordance with the present invention.

| DESCRIPTIVE KEY | |
|---|---|
| 10 | carrier for mobile phone |
| 11 | mobile telephone |
| 12 | user |
| 20 | carrier |
| 21 | front side |
| 22 | rear side |
| 23 | bottom side |
| 24 | left side |
| 25 | right side |
| 26 | opening |
| 27 | interior |
| 28 | adornment aperture |
| 29a | upper cord aperture |
| 29b | lower cord aperture |
| 30 | neck cord |
| 30a | first neck cord end |
| 30b | second neck cord end |
| 31a | upper slot |
| 31b | lower slot |
| 35 | cord clasp |

-continued

| DESCRIPTIVE KEY | |
|---|---|
| 36 | clasp body |
| 37 | shaft |
| 38 | spring clip |
| 39 | clasp body backside |
| 40 | belt clip |
| 41 | back panel |
| 42 | upper bend |
| 43 | lever panel |
| 44 | lever panel lower end |
| 45 | retaining protrusion |
| 50 | ornamental adornment |
| 51 | decorative face |
| 52 | pin |
| 53 | pin head |
| 54 | first bore hole |
| 55 | second bore hole |
| 56 | third bore hole |
| 57 | bore shoulder |
| 58 | entry portion |
| 59 | shaft head |
| 60 | shaft shoulder |
| 61a | first cut out |
| 61b | second cut out |
| 62 | spring |
| 63 | curved upper end |
| 64 | tab |
| 65 | tab lower end |

DETAILED DESCRIPTION OF THE PREFERRED EMBODIMENT

In accordance with the invention, the best mode is presented in terms of a preferred embodiment, herein depicted within FIGS. 1 through 12. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

It can be appreciated that, although such terms as first, second, etc. may be used herein to describe various elements, these elements should not be limited by these terms. These terms are only used to distinguish one element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one or more stated elements, steps or functions without precluding one or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 12, depicting a carrier for mobile phone, identified generally by reference to a device 10, where like reference numerals represent similar or like parts. In accordance with the teachings of the present invention, the device 10 is adapted to hold and carry a mobile telephone 11 or other portable electronic device and be worn by a user 12 and includes a plurality of interchangeable ornamental adornments 50.

Referring first to FIG. 1, the device 10 is intended to hold a mobile or cellular telephone 11 and be worn by a user 12. The device 10 includes a carrier 20 that can be attached to a neck cord 30 or a belt clip 40 in order to be worn by the user 12. The device 10 includes two alternate ways to wear the carrier 20. The first method is by connecting the neck cord 30 and a cord clasp 35 to the rear side 22 of the carrier 20 which allows the user 12 to wear the device 10 like a necklace. The second method is by connecting a clip 40 to the rear side 22 of the carrier 20 which allows the user 12 to clip the device 10 to a belt, waistband, or similar article. The rear side 22 includes a pair of slots 31 for removable connection of either the cord clasp 35 or the belt clip 40. As seen in FIG. 1, the device 10 is worn around the neck of the user 12 using the neck cord 30 in a similar manner to a necklace or bolo tie.

Referring now to FIGS. 2 through 6, the carrier 20 includes a front side 21, a rear side 22, a common bottom side 23 connecting the front side 21 and rear side 22, a left side 24, and a right side 25. Preferably the rear side 22 is longer than the front side 21. The left side 24 and right side 25 each extend from longitudinal side edges of the front side 21 to the rear side 22 and do not cover the lower end of the body of the carrier 20 forming openings 26 in the lower end. The openings 26 provide open areas for lower corners of certain varieties and styles of mobile telephones to protrude. The body of the carrier 20 defines a hollow interior 27 suitably sized to receive a mobile telephone 11 which is inserted therein. The front side 21 and rear side 22 are preferably made from a durable semi-rigid material, such as leather, plastic, vinyl, or similar natural or synthetic materials. The left side 24 and right side 25 are preferably made from a durable and flexible material, such as spandex, neoprene, or similar synthetic elastic material.

Figure 2:
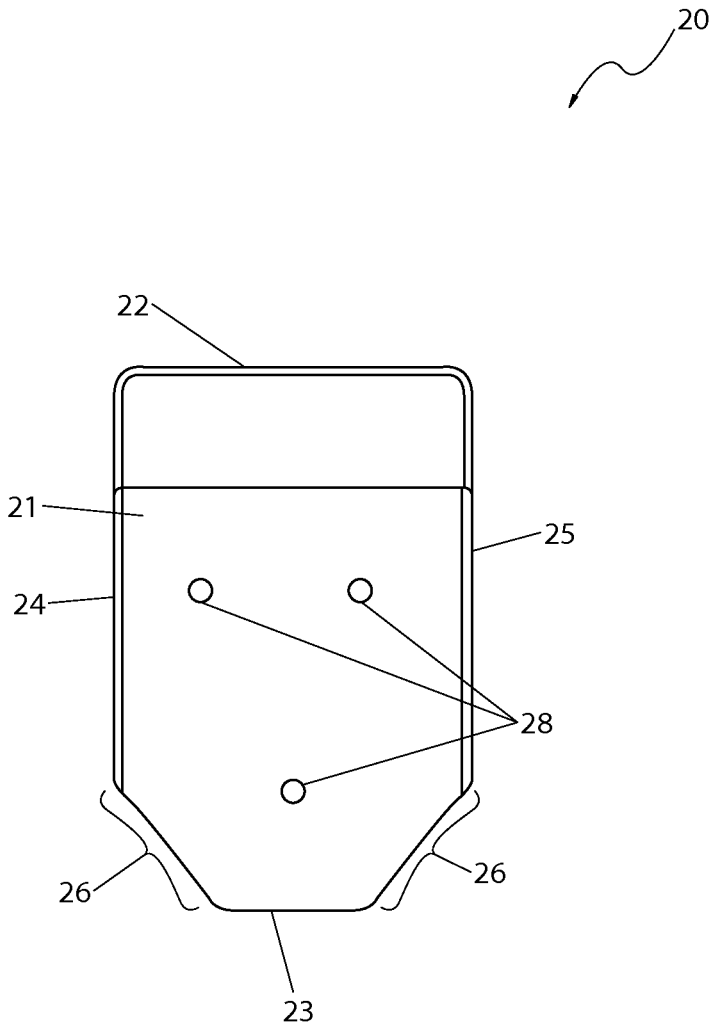
FIG. 2 is a front elevation view of the carrier for mobile phone.
Figure 3:
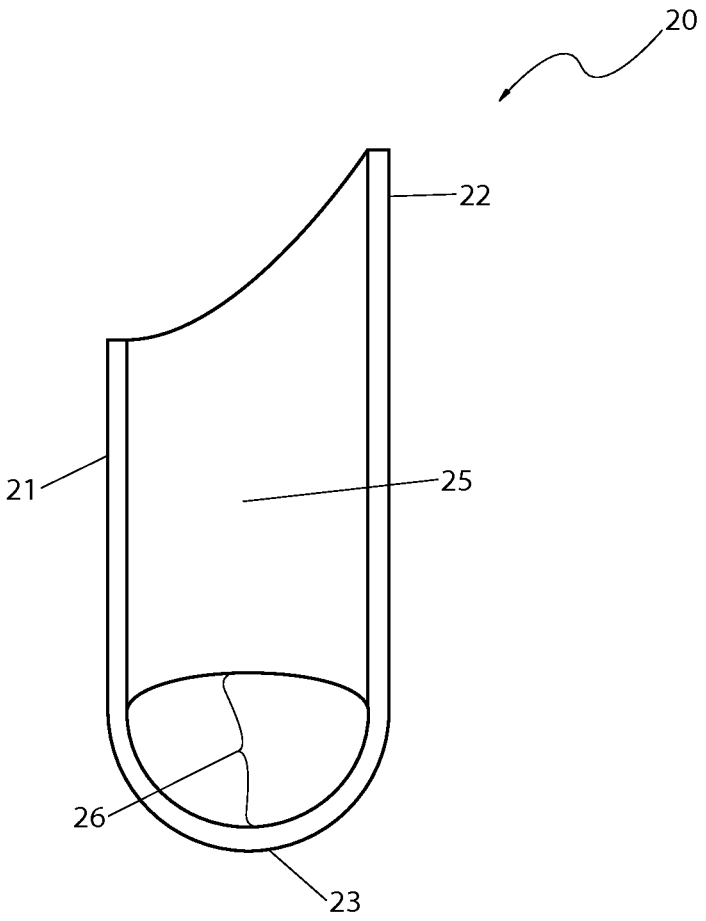
FIG. 3 is side elevation view of the carrier for mobile phone.
Figure 5:
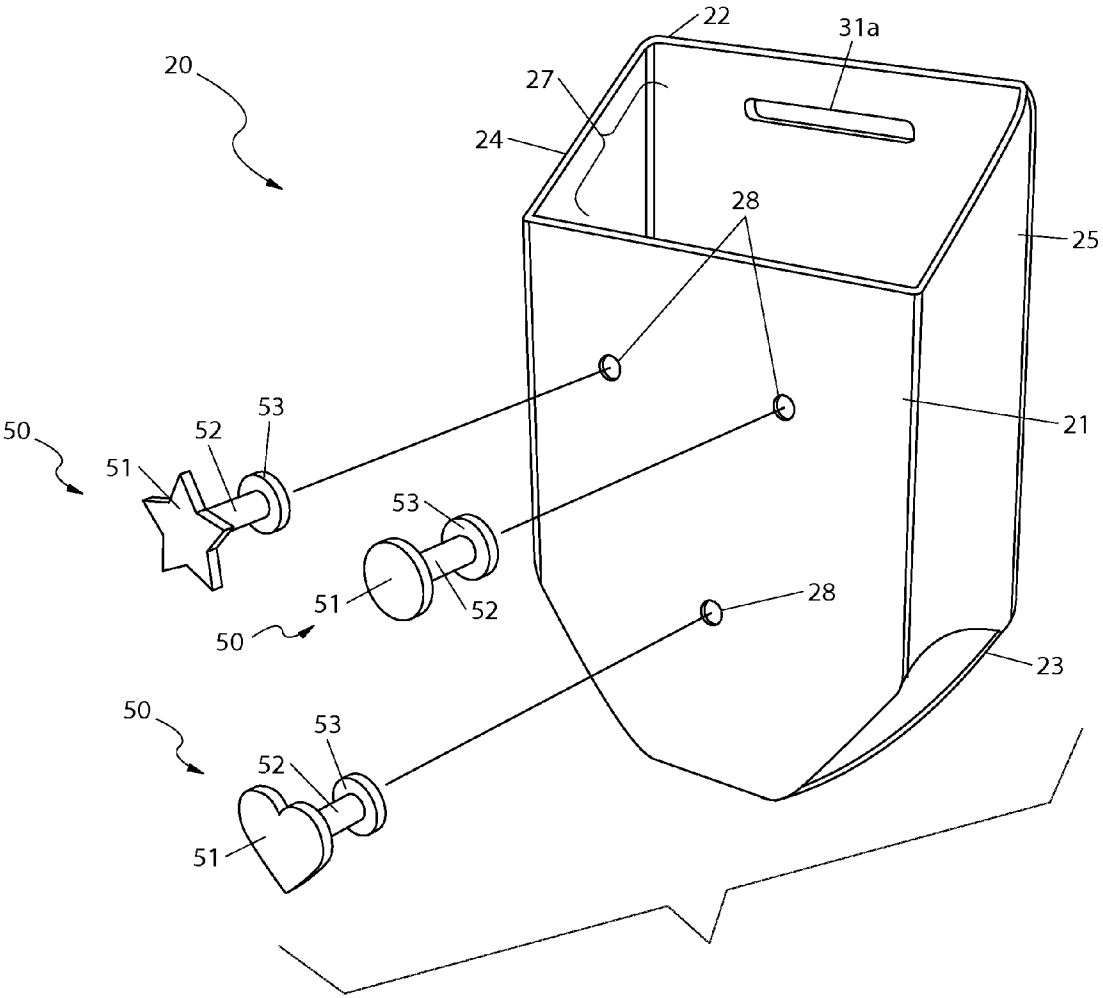
FIG. 5 is an exploded perspective view of the carrier for mobile phone depicting a plurality of ornamental attachments.

As best seen in FIGS. 1, 2, and 5, the front side 21 also includes a plurality of ornamental adornment apertures 28 disposed at various locations throughout its surface for receiving the ornamental adornments 50. Each aperture 28 receives one of a plurality of interchangeable and replaceable ornamental adornments 50. FIG. 2 illustrates an example embodiment of the device 10 having three apertures oriented in a generally triangular shape; however, it can be appreciated that the number and locations of the apertures 28 can vary depending on the final design of the device 10, as depicted in FIGS. 1 and 5. As shown in FIG. 2, the triangular orientation of the plurality of adornment apertures 28 includes two aligned upper adornment apertures 28 which would allow for the attachment of an existing piece of jewelry, such as a broach, pin, or similar larger ornamental adornment.

As seen in FIG. 5, the plurality of ornamental adornments 50 are applied to the carrier front side 21 by inserting attachment within the adornment apertures 28. Each adornment 50 is essentially a piece of decorative jewelry which allows the user 12 to customize the appearance of the carrier 20. Each adornment 50 generally includes a decorative face 51, a pin 52 affixed to and extending perpendicularly from a backside of the face 51, and a pin head 53 protruding radially outward from an end of the pin 52. The decorative face 51 is generally a decorative or ornamental item and can be of any type of fine jewelry or costume jewelry. Various different sizes, styles, and types of adornments 50 can be used with the device 10.

The components which form the decorative face 51 of the adornments 50; including the fabrication of mounting plates or exterior frames or the use of gemstones, precious metals, plastic, glass, or other materials utilized in jewelry making are substantially similar to similar jewelry components and jewelry making techniques well known in the art and are therefore not described in any further detail.

Figure 10:
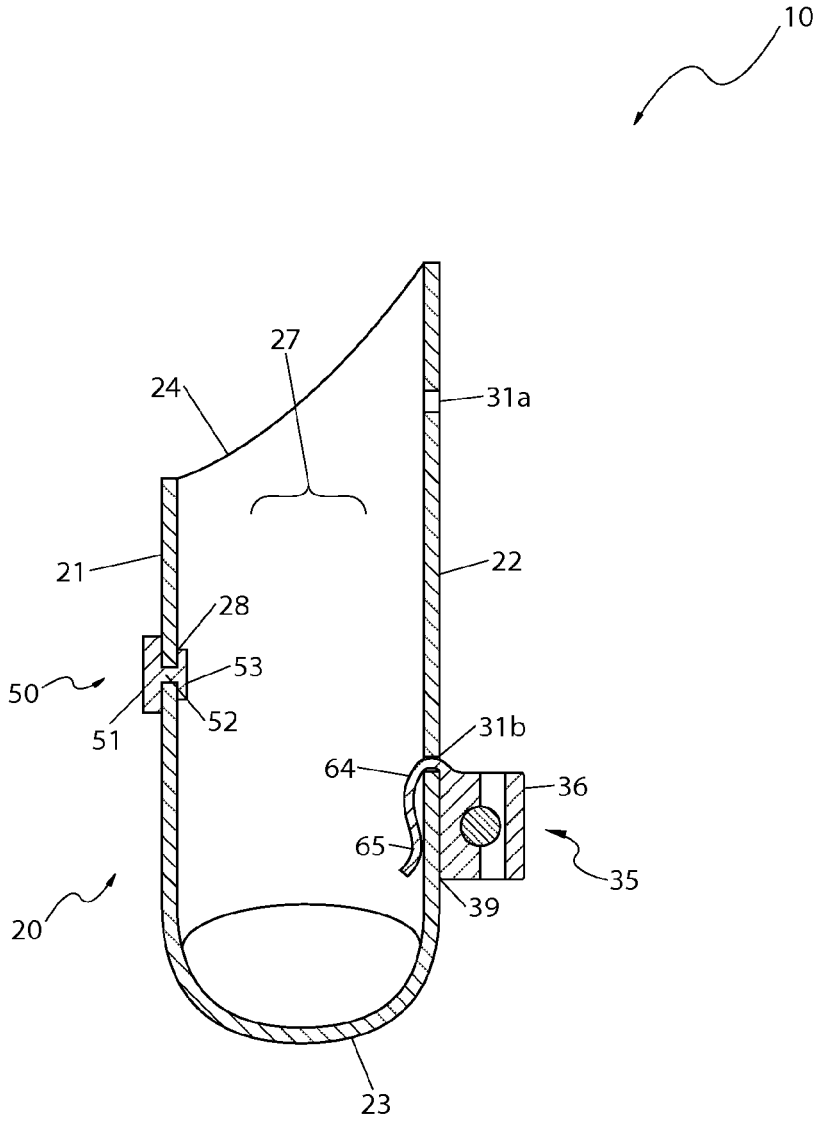
FIG. 10 is a cross sectional view of the carrier for mobile phone depicted with ornamental attachment and the neck cord clasp attached.

As best seen in FIGS. 5 and 10, the pin 52 is a generally rigid, cylindrical member having a diameter substantially equal to the internal diameter of the aperture 28 and a length slightly larger than the thickness of the front side 21. The pin head 53 protrudes outward perpendicularly from the end of the pin 52 opposite the face 51. The diameter of the pin head 53 is slightly larger than the internal diameter of the aperture 28 in order to retain the adornment 50 within the aperture 28 when inserted while also allowing the adornment to be removed. The pin head 53 is made of a semi-flexible material such as rubber, plastic, or the like; such that the surface of the pin head 53 deflects inwardly or outwardly in response to a sufficient force applied when inserting or removing the adornment 50 with respect to the aperture 28. As illustrated in the example embodiment, the pin head 53 has a generally circular shape with a flat backside surface as to not protrude within the interior 27 of the carrier 20 or interfere with the insertion of the mobile phone 11. It can be appreciated that the shape of the pin 52 and the pin head 53 can be of various geometric shapes and sizes being suitable for insertion, removal, and retention relative to the adornment apertures 28.

Figure 4:
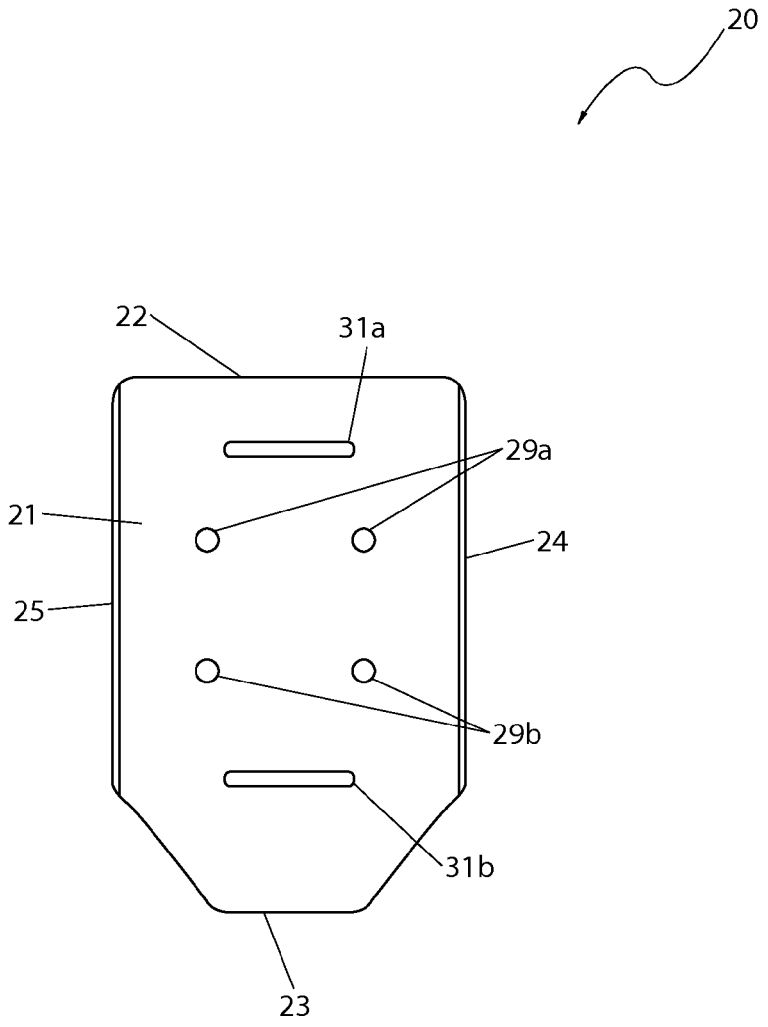
FIG. 4 is front elevation view of the carrier for mobile phone.
Figure 6:
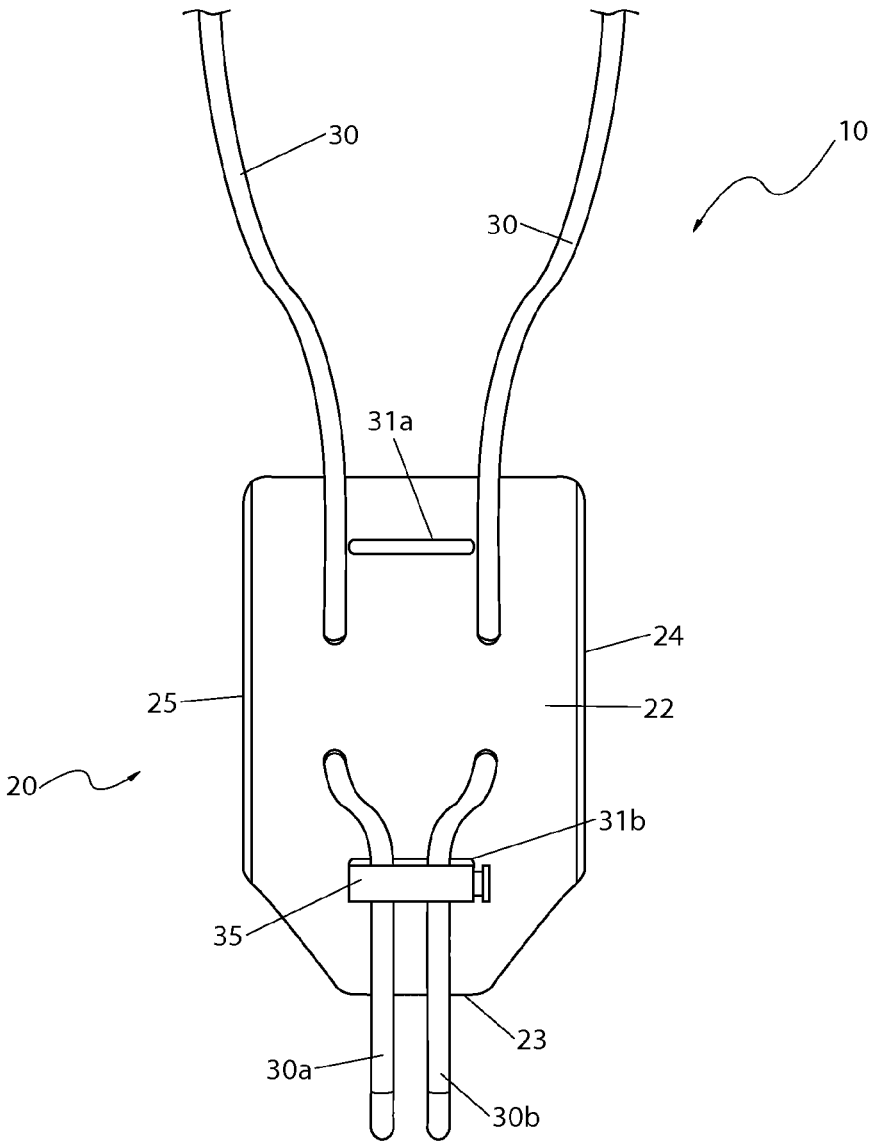
FIG. 6 is a rear elevation view of the carrier for mobile phone depicted with a neck cord attached.
Figure 7:
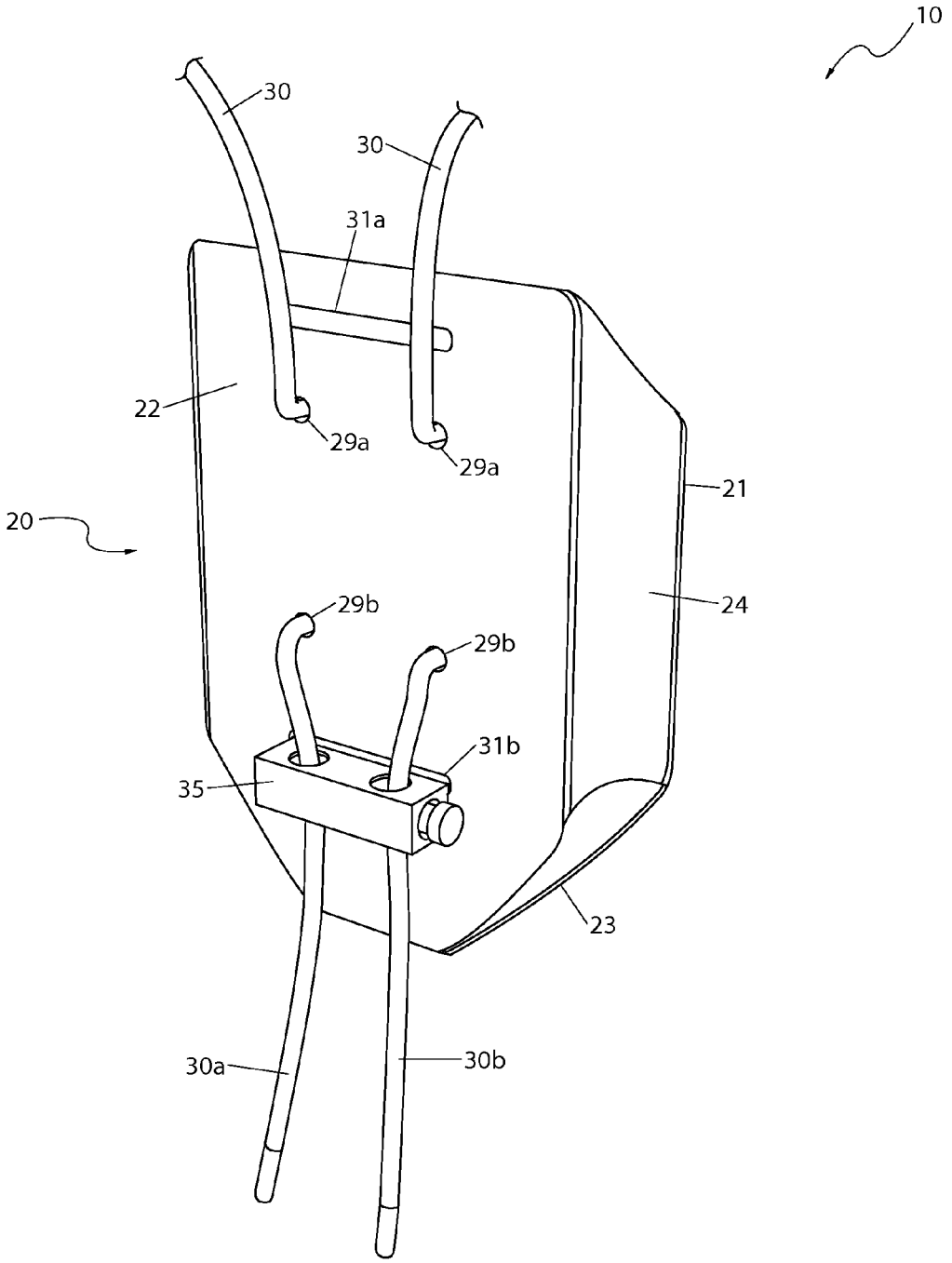
FIG. 7 is a rear perspective view of the carrier for mobile phone depicted with a neck cord clasp attached.

As best seen in FIGS. 4 and 6, the carrier back side 22 includes a plurality of cord apertures 29 disposed through its surface for receiving the neck cord 30. As illustrated in the example embodiment, the back side 22 includes two pairs of aligned apertures 29 located at an upper middle portion. A first and second end 30*a*, 30*b* of the neck cord 30 are threaded through vertically aligned apertures 29, particularly inward through upper apertures 29*a* and outward through lower apertures 29*b*. The ends 30*a*, 30*b* of the neck cord 30 extend through the lower apertures 29*b* and dangle below a cord clasp 35.

The neck cord 30 can be any elongated member that extends around the user's neck and is held together in the front of the user 12 by the cord clasp 35 of the carrier 20. Preferably the neck cord 30 is of sufficient length for the user 12 to wear comfortably and safely suspend the carrier 20 from their neck. The neck cord 30 can be made from leather, metal, wire, precious metal, or similarly durable material in the form of a cord, rope, chain in a braided or twisted configuration. The neck cord 30 preferably has a generally circular cross-sectional shape and can be of any level of ornamentation depending upon the overall look desired by the user 12. For example, the neck cord 30 can be a simple braided leather cord having decorative ends 30*a*, 30*b* for a more casual or sporty look or can be a gold or silver chain for a more formal appearance when used in combination with and to complement the various ornamental adornments 50 applied to the carrier 20.

Figure 8:
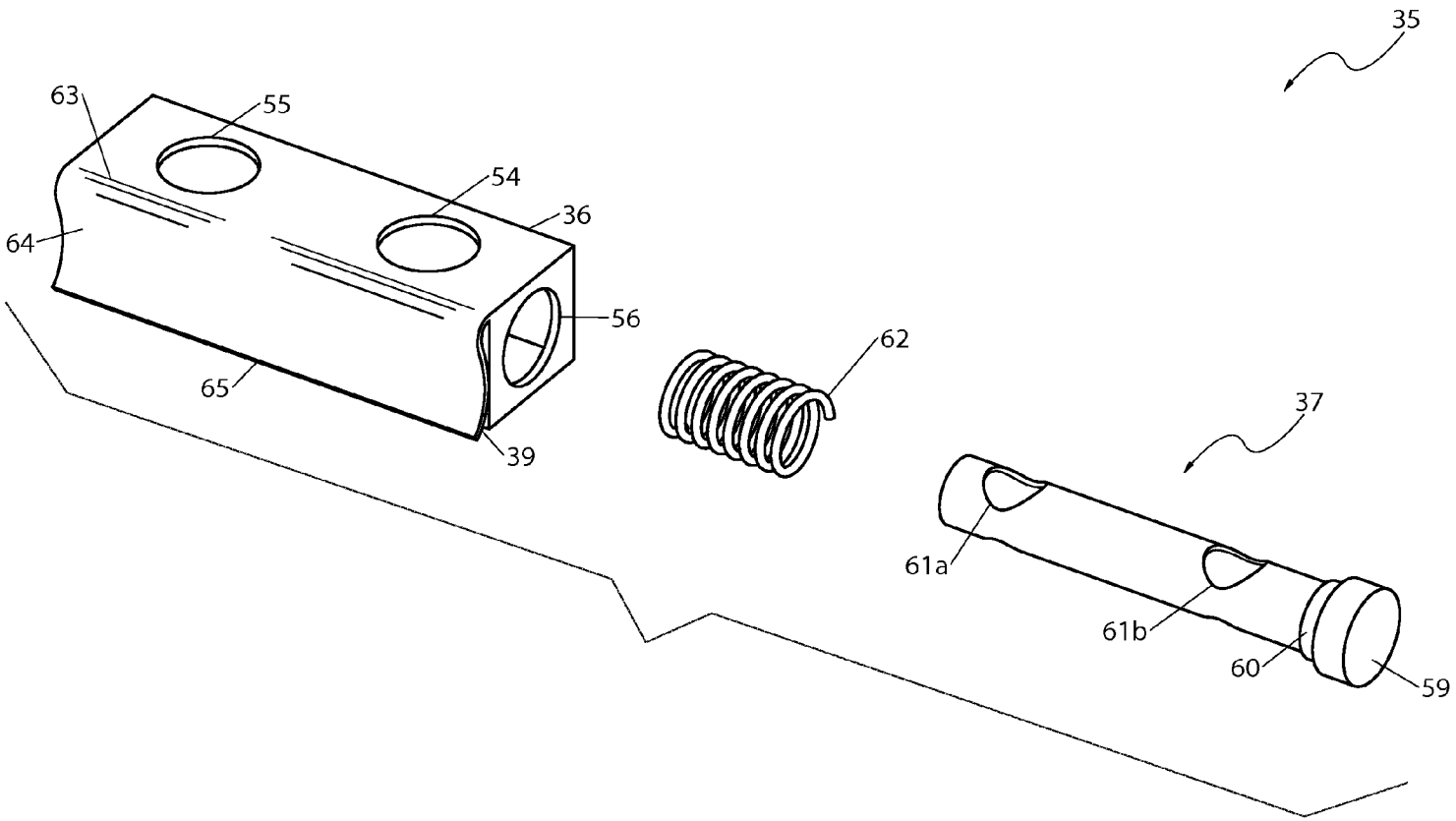
FIG. 8 is an exploded view of a neck cord clasp of the carrier for mobile phone.
Figure 9:
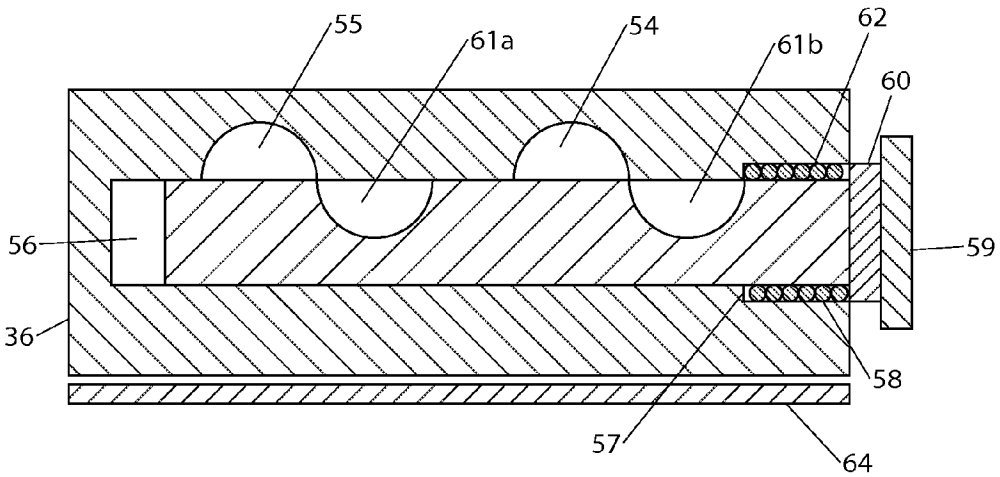
FIG. 9 is a cross sectional view of the neck cord clasp.

Referring now to FIGS. 8, 9, and 10 a lower slot 31*b* is disposed at a lower middle portion of the carrier rear side 22 for attachment of a cord clasp 35 used to secure the neck cord 30. The cord clasp 35 is preferably made of any suitable durable and resilient material, such as metal, plastic, or the like. The cord clasp 35 generally includes a clasp body 36, a shaft 37, and a spring clip 38. The spring clip 36 is integral to and extends from an upper edge of a backside 39 of the clasp body 36. The spring clip 36 is configured to slide within the lower slot 31*b* to attach the cord clasp 35 to the carrier rear side 22. The spring clip 36 includes a curved upper end 63 and a lever tab 64 extending from the curved upper end 63 generally parallel to the backside 39 of the clasp body 36. The tab 64 is curved toward the clasp body 36 such that a lower end 65 is biased toward and in contact with the lower portion of the clasp body backside 39 by the curved upper end 63. In use, the tab lower end 65 is pulled slightly away from the clasp body backside 39 creating a gap therebetween. The tab 64 is then inserted within the lower slot 31*b* and returns to the normal biased position where the carrier rear side 22 is compressed between the clasp body backside 39 and tab lower end 65, thus retaining the cord clasp 35 to the carrier 20.

The clasp body 36 includes a first bore hole 54 and a second bore hole 55 that each extend entirely through the clasp body 36 from top to bottom. The bore holes 54, 55 are generally in parallel alignment with each other and in the same general direction. A third bore hole 56 extends into the clasp body 36 from a side in a direction generally perpendicular to and partially intersects the first and second bore holes 54, 55. The parallel first bore hole 54 receives the first end 30*a* of the neck cord 30 and the second bore hole 55 receives the second end 30*b* of the neck cord 30. The ends 30*a*, 30*b* extend through the bore holes 54, 55 and dangle below the cord clasp 35. The third bore hole 56 also includes an interior bore shoulder 57 and larger diameter bore hole entry portion 58. The entry portion 58 extends from the shoulder 57 to a side exterior of the clasp body 36.

The shaft 37 includes a shaft head 59 on one end thereof. A shaft shoulder 60 is located on the underneath side of the shaft head 59 adjacent the shaft 37 at the juncture of the shaft 37 and the shaft head 32. The shaft shoulder 60 has a diameter slightly than the diameter of the shaft 37. The shaft 37 and the shaft shoulder 60 are suitably and appropriately sized to cooperate and extend within the third bore hole 56 and entry portion 58. The shaft 37 also includes a pair of depressions or cut outs 61, correspondingly illustrated as first cut out 61*a* and second cut out 61*b*.

A compression spring 62 extends about the shaft 37 within the entry portion 58 of the third bore hole 56 and biases the shaft 37 against the ends 30*a*, 30*b* of the neck cord 35 to hold the neck cord 30 in place. Specifically, the spring 62 is biased between the bore shoulder 57 of the entry portion 58 and the shaft shoulder 60 of the shaft 35. The exterior of the shaft 37 cooperates with and contactingly engages the neck cord 30 within the first and second bore holes 54, 55 to hold or bias the ends 30*a*, 30*b* of the neck cord 30 within the first and second bore holes 54, 55. When in an outwardly biased position, the shaft 37 keeps the cord clasp 35 from moving upon the neck cord 35, and vice versa, to keep either or both ends 30*a*, 30*b* of the neck cord 35 from slipping within the cord clasp 35.

As illustrated in FIG. 9, the clasp body 36 is shown in cross section and the parallel first and second bore holes 54, 55 are shown extending through the clasp body 36. The shaft 37 is shown extending into the third bore hole 56 in the outwardly biased position. The spring 62 is shown within the larger diameter entry portion 58 between the bore shoulder 57 and the shaft shoulder 60.

In the outwardly biased position, the cut outs 61*a*, 61*b* are displaced slightly to the side of the first and second bore holes 54, 55, respectively, with which they cooperate. The side displacement of the cut outs 61*a*, 61*b*, due to the biasing of the spring 62, serves to compress the neck cord 30, which are not shown in FIG. 9, against the interior walls of the first and second bore holes 54, 55 to hold the neck cord 30 in place.

To loosen the neck cord 30 or to remove from the carrier 20, the shaft head 59 is depressed and placed in an inwardly biased position, which aligns the cut outs 61*a*, 61*b* with the corresponding bore holes 54, 55. When the respective cut outs 61*a*, 61*b* are aligned with the bores 54, 55, the ends 30*a*, 30*b* of the neck cord 30 can easily slide up or down within the parallel bores 54, 55. Upon release of applied pressure on shaft head 59, the shaft 37 will again be biased by spring 62 and will move the cut outs 61*a*, 61*b* out of alignment with their respective bore holes 54, 55. The neck cord 30 is then again pressed against the exterior of the shaft 37 to hold the ends 30*a*, 30*b* within the bore holes 54, 55.

Figure 11:
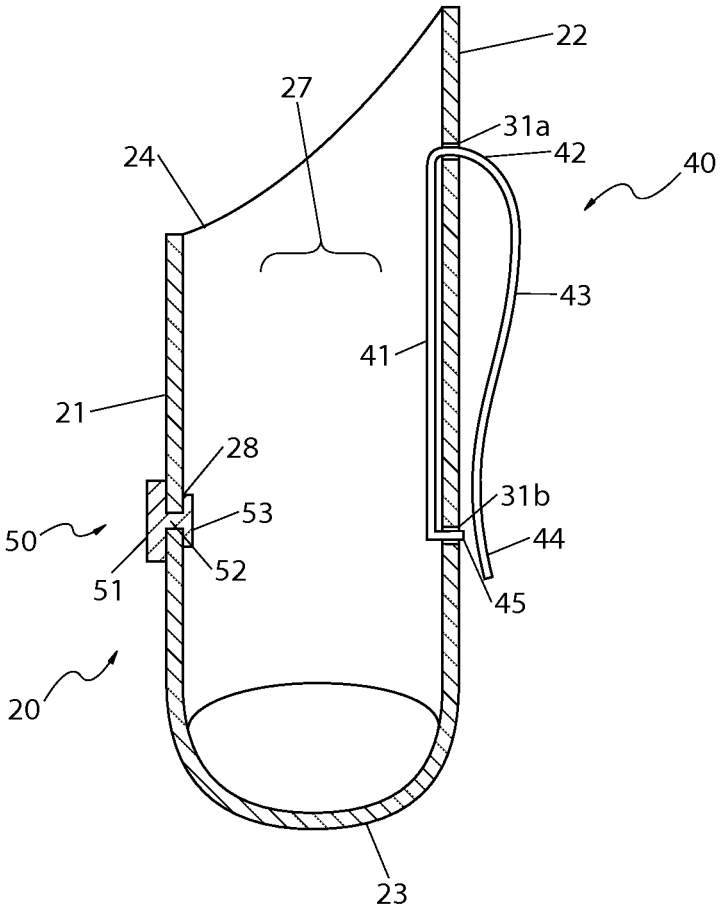
FIG. 11 is a cross sectional view of the carrier for mobile phone depicted with ornamental attachment and a clip attached; and, FIG. 12 is a rear perspective view of the carrier for mobile phone depicted with the clip attached.
Figure 12:
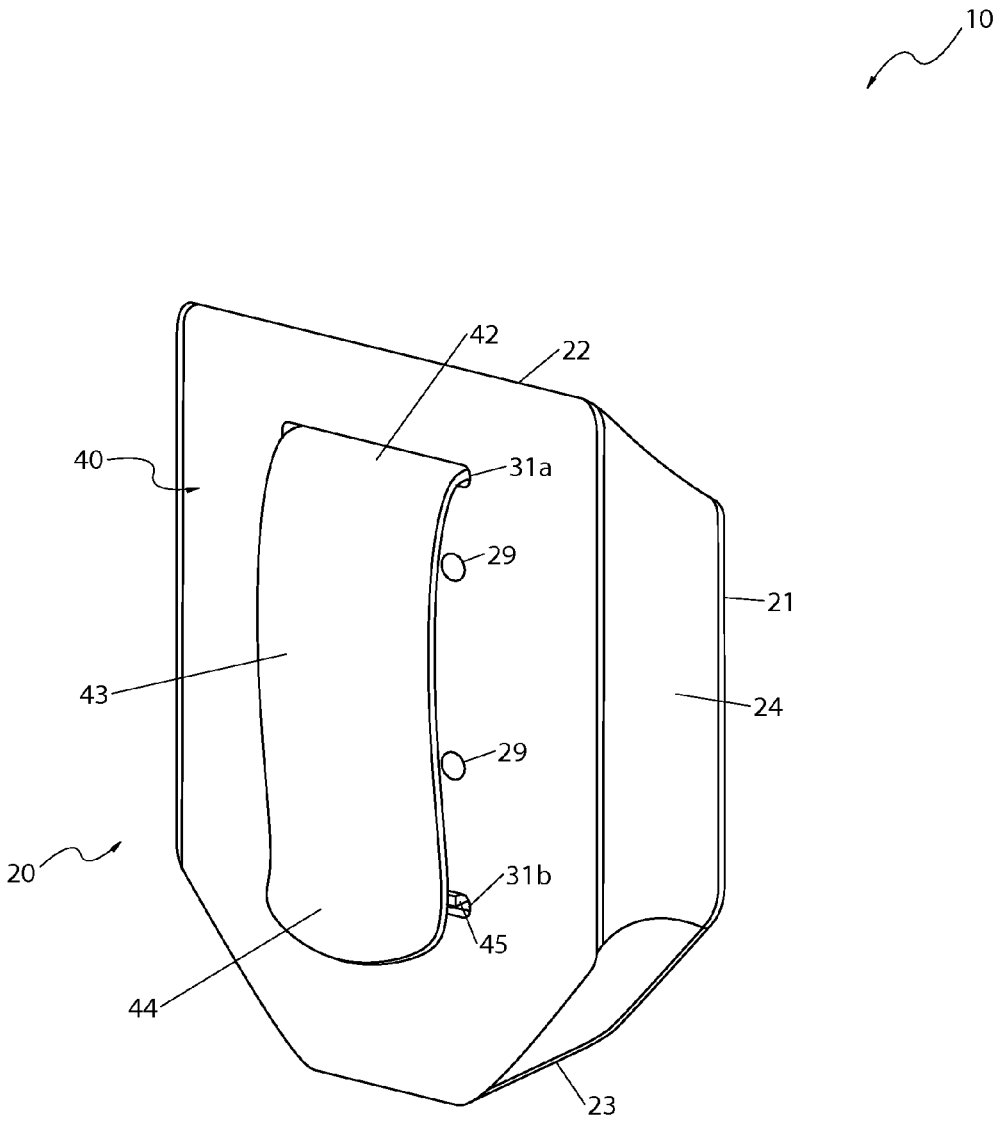

Referring now to FIGS. 11 and 12, an upper slot 31*b* is disposed at an upper middle portion of the carrier rear side 22 for attachment of the belt clip 40 used to secure the carrier 20 to a belt or similar support article. The belt clip 40 generally includes a straight back panel 41, an upper bend 42, and a lever panel 43. The lever panel 43 is integral to and extends from an upper edge of the back panel 41 about the curved upper bend 42. The back panel 43 is configured to slide within the upper slot 31*a* and engage the lower slot 31*b* to attach the belt clip 40 to the carrier rear side 22. The lever panel 43 extends from the upper bend 42 generally parallel to the back panel 41. The lever panel 43 is curved toward the back panel 41 such that a lower end 44 is biased toward and in contact with the lower portion of the back panel 41 by the upper bend 42. The lower end of the back panel 41 includes a retaining protrusion 45 extending perpendicularly outward toward the lever panel 43. In use, the lever tab lower end 44 is pulled slightly away from the back panel 41 creating a gap therebetween. The back panel 41 is then inserted within the upper slot 31 and pushed downward to the lower slot 31*b*, where the retaining protrusion 45 extends outward through the lower slot 31*b* and the lever panel 43 returns to the normal biased position such that the carrier rear side 22 is compressed between the back panel 41 and the lever panel lower end 44, thus retaining the belt clip 40 to the carrier 20. The belt clip 40 is preferably made of any suitable durable and resilient material, such as metal, plastic, or the like. In certain embodiments, the lever panel lower end 44 can also include a rubber or plastic coating applied to an exterior surface. In yet another embodiment, the belt clip 40 can be made of a magnetic material.

It can be appreciated by one skilled in the art that other styles and configurations of the present invention can be easily incorporated into the teachings of the present disclosure and only certain particular configurations have been shown and described for purposes of clarity and disclosure and not by way of limitation of scope.

In accordance with the principles of the present invention, the various embodiments can be utilized by the user in a simple and effortless manner with little or no training in general accordance with FIG. 1 through FIG. 12. It can be appreciated that the any steps required to utilize the device 10 as described above can performed in alternative order and as such should not be viewed as a limiting factor.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A carrier for mobile telephone comprising:

a carrier comprising an open interior configured to removably receive a mobile telephone, comprising a rear side having two pairs of aligned cord apertures disposed in a middle portion and a slot disposed in a lower middle portion;

a neck cord having first and second ends removably attachable to said two pairs of aligned cord apertures for extending around a neck of a user;

a cord clasp removably attachable to said slot for retaining said carrier to a selected location upon said neck cord, comprising:

a clasp body;

a first bore hole extending entirely through said clasp body for receiving said first end of said neck cord;

a second bore hole extending entirely through said clasp body substantially parallel to said first bore hole for receiving said second end of said neck cord;

a third bore hole extending into said clasp body from a side substantially perpendicular to and at least partially intersecting said first and second bore holes;

a shaft disposed within said third bore hole for locking said first and second ends of said neck cord within said first and second bore holes when in an outwardly biased position;

a first cut out and a second cut out disposed in said shaft for alignment with said first and second bore holes when said shaft is in an inwardly biased position;

a spring for biasing said shaft in said outwardly biased position; and, a spring clip extending from an upper edge of a backside of said clasp body for insertable attachment within said slot; and, at least one ornamental adornment removably attachable to said carrier.

2. The device of claim 1, wherein said carrier is made of a resilient material.

3. The device of claim 1, wherein said carrier further comprises:

a front side for removable attachment of said at least one ornamental adornment;

a rear side directly connected to said front side by a bottom side for removable attachment of said neck cord and said cord clasp;

a left side and a right side connected between opposing longitudinal edges of said front side and said back side; and, an opening defined in a lower end of said left side and said right side.

4. The device of claim 3, wherein said front side and said rear side are made of a durable and semi-rigid material.

5. The device of claim 3, wherein said left side and said right side are made of a durable and semi-elastic material.

6. The device of claim 1, wherein said carrier further comprises a front side comprising at least one adornment aperture for removable attachment of said at least one ornamental adornment.

7. The device of claim 1, wherein said shaft comprises a shaft head on an end thereof and a shaft shoulder disposed beneath said shaft head and said third bore hole comprises an entry portion having a larger diameter defining an interior bore shoulder; and, wherein said spring extends between said bore shoulder and said shaft shoulder within said third bore hole entry portion.

8. The device of claim 1, wherein said ornamental adornment comprises:

a decorative face;

a pin extending perpendicularly outward from a back surface of said decorative face having a diameter approximately equivalent to an interior diameter of said adornment aperture; and, a flexible pin head disposed on an end of said pin having a diameter greater than said interior diameter of said adornment aperture and insertable therewithin.

9. The device of claim 1, further comprising a belt clip removably attachable to said carrier for connection to a belt or waistband of said user.

10. A carrier for mobile telephone comprising:

a carrier defining an open interior configured to removably receive a mobile telephone comprising:

a front side having a plurality of adornment apertures disposed throughout;

a rear side directly connected to said front side by a bottom side and having an upper slot disposed in an upper middle portion, a lower slot disposed in a lower middle portion, a pair of upper cord apertures disposed in a middle portion, and a pair of lower cord apertures aligned with and parallel to said pair of upper cord apertures;

a left side and a right side connected between opposing longitudinal edges of said front side and said back side;

an opening defined in a lower end of said left side and said right side being proximate lower corners of said carrier;

a neck cord having a first end first and a second end threadingly connected through said aligned pairs of upper and lower cord apertures for extending around a neck of a user;

a cord clasp comprising:

a clasp body;

a first bore hole extending entirely through said clasp body for receiving said first end of said neck cord;

a second bore hole extending entirely through said clasp body substantially parallel to said first bore hole for receiving said second end of said neck cord;

a third bore hole extending into said clasp body from a side substantially perpendicular to and at least partially intersecting said first and second bore holes;

a shaft disposed within said third bore hole for locking said first and second ends of said neck cord within said first and second bore holes when in an outwardly biased position;

a first cut out and a second cutout disposed in said shaft for alignment with said first and second bore holes when said shaft is in an inwardly biased position;

a spring for biasing said shaft in said outwardly biased position; and, a spring clip extending from an upper edge of a backside of said clasp body for insertable attachment within said lower slot;

a belt clip insertably connected within said upper slot for connecting said carrier to a belt or waistband of said user; and, a plurality of interchangeable ornamental adornments removably attachable to said adornment apertures.

11. The device of claim 10, wherein each of said ornamental adornments comprises:

a decorative face;

a pin extending perpendicularly outward from a back surface of said decorative face having a diameter approximately equivalent to an interior diameter of said adornment aperture; and, a flexible pin head disposed on an end of said pin having a diameter greater than said interior diameter of said adornment aperture and insertable therewithin.

12. The device of claim 10, wherein said shaft comprises a shaft head on an end thereof and a shaft shoulder disposed beneath said shaft head and said third bore hole comprises an entry portion having a larger diameter defining an interior bore shoulder; and, wherein said spring extends between said bore shoulder and said shaft shoulder within said third bore hole entry portion.

13. The device of claim 10, wherein said front side and said rear side are made of a durable and semi-rigid material and said left side and said right side are made of a durable and semi-elastic material.

14. The device of claim 10, wherein said cord clasp spring clip comprises:

an upper curved end extending from said upper edge of said backside of said clasp body; and, a lever tab extending downward from said upper curved end for insertable attachment within said lower slot, said lever tab having an inwardly curved shape for biasing a lower end in contact with a lower portion of said backside of said clasp body.

15. The device of claim 10, wherein said belt clip comprises:

a substantially straight back panel;

an upper bend extending from an upper edge of said back panel;

a lever panel extending downward from said upper bend for insertable attachment within said upper slot; and, a retaining protrusion extending perpendicularly outward from a lower end of said back panel for insertion through said lower slot;

wherein said lever panel has an inwardly curved shape for biasing a lower end in contact with said retaining protrusion.

16. The device of claim 10, wherein said neck cord and said plurality of ornamental adornments comprise costume jewelry.

17. The device of claim 10, wherein said neck cord and said plurality of ornamental adornments comprise precious jewelry.

* * * * *